US011400515B2

(12) United States Patent
Mueller et al.

(10) Patent No.: US 11,400,515 B2
(45) Date of Patent: Aug. 2, 2022

(54) METHOD OF MANUFACTURING A COMPONENT USING A SINTER JOINING PROCESS

(71) Applicant: Rolls-Royce Deutschland Ltd & Co KG, Blankenfelde-Mahlow (DE)

(72) Inventors: Ralf Mueller, Rangsdorf (DE); Enrico Daenicke, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 165 days.

(21) Appl. No.: 16/510,434

(22) Filed: Jul. 12, 2019

(65) Prior Publication Data

US 2020/0030883 A1 Jan. 30, 2020

(30) Foreign Application Priority Data

Jul. 27, 2018 (DE) ..... 10 2018 212 625.9

(51) Int. Cl.
*B22F 7/06* (2006.01)
*B22F 5/00* (2006.01)

(52) U.S. Cl.
CPC ..... *B22F 7/064* (2013.01); *B22F 5/009* (2013.01); *B22F 2301/15* (2013.01)

(58) Field of Classification Search
CPC ..... F05D 2230/22; F05D 2230/23–239; F05D 2230/40; F05D 2230/50; F05D 2230/51;
(Continued)

(56) References Cited

U.S. PATENT DOCUMENTS 5,948,549 A * 9/1999 Takayama ..... B22F 7/06 428/676
2017/0045178 A1* 2/2017 Hoffmann ..... F16L 58/1054
(Continued)

FOREIGN PATENT DOCUMENTS

DE 102012109231 A1 5/2014
WO 2015079249 A1 6/2015

OTHER PUBLICATIONS

German Search Report dated Apr. 5, 2019 for counterpart German Patent Application No. DE 10 2018 212 625.9.

*Primary Examiner* — Anthony J Zimmer
*Assistant Examiner* — Dean Mazzola
(74) *Attorney, Agent, or Firm* — Shuttleworth & Ingersoll, PLC; Timothy J. Klima

(57) ABSTRACT

The production of engine parts with a complex geometrical structure. More particularly, a method for producing a complex part, comprising making available a first component, having a thermal expansion coefficient of the first component; a first joining surface; and a first bearing surface; making available a second component, having a thermal expansion coefficient of the second component; a second joining surface; a second bearing surface; and making available a jacket element, having a thermal expansion coefficient of the jacket element; and a jacket-element bearing surface; and heating the first component, the second component and the jacket element from a first temperature to a second temperature in order to carry out a joining process on the first component and the second component. Furthermore, a part, in particular for a gas turbine engine for an aircraft, and to a gas turbine engine of this kind.

15 Claims, 7 Drawing Sheets

(58) Field of Classification Search
CPC ..... F05D 2230/53; B22F 5/008; B22F 5/009; B22F 2301/15; B23K 1/0018
See application file for complete search history.

(56) References Cited

U.S. PATENT DOCUMENTS

2018/0328176 A1* 11/2018 Sakala ..... F01D 5/282
2019/0070789 A1* 3/2019 Yousefiani ..... C23C 4/12

* cited by examiner

METHOD OF MANUFACTURING A COMPONENT USING A SINTER JOINING PROCESS

This application claims priority to German Patent Application DE102018212625.9 filed Jul. 27, 2018, the entirety of which is incorporated by reference herein.

The present disclosure relates in general to engine technology. In particular, the present disclosure relates to the production of engine parts with a complex geometrical structure. More particularly, the present disclosure relates to a production method for an engine component involving the application of force during a sinter joining process.

Joining is a suitable production method for complex parts or groups of parts, especially for parts in the aerospace sector which can be produced integrally only with difficulty, if at all. In this context, there are various joining techniques, e.g. welding, brazing, adhesive bonding but also screwed joints and mechanical joints designed in some other way. At the same time, however, it is not possible to join all workpieces because, for example, the materials used are insufficiently suitable for welding or brazing or because the joining methods can be made available only with additional weight, in the case of a screwed joint for example, or only with limited temperature stability, in the case of adhesive or brazed joints.

There may therefore be a need to implement joining methods specifically suitable for aeronautical applications in order to produce complex integral parts.

There may furthermore be a need, in the case of a joining process of this kind, to be able to implement further measures, thereby enabling a preferred joint and thus a joint with an enhanced joining quality to be implemented.

At least such a need may be met by the subject matter of the independent claims. Preferred embodiments will be found in the dependent claims and are explained in greater detail in the rest of the description.

According to a first aspect of the present disclosure, a method for producing a complex part is indicated, comprising making available a first component, having a thermal expansion coefficient of the first component, a first joining surface and a first bearing surface. A second component is furthermore made available, having a thermal expansion coefficient of the second component, a second joining surface and a second bearing surface. A jacket element is furthermore made available, having a thermal expansion coefficient of the jacket element and a jacket-element bearing surface. The first component, the second component and the jacket element are heated from a first temperature to a second temperature in order to carry out a joining process on the first component and the second component. During this process, the first component and the second component can be brought into contact in at least a partial area of the first joining surface and of the second joining surface, thus enabling a joint to be formed in the area of contact between the first joining surface and the second joining surface. In this case, the jacket element at least partially surrounds the first component and the second component and can be brought into contact by means of the jacket-element bearing surface with the first bearing surface and the second bearing surface. The thermal expansion coefficient of the jacket element is lower than the thermal expansion coefficient of the first component and/or the thermal expansion coefficient of the second component, wherein the thermal expansion coefficient of the jacket element and the thermal expansion coefficient of the first component and/or the thermal expansion coefficient of the second component are designed in such a way as to bring the jacket-element bearing surface into contact with the first bearing surface and the second bearing surface and to bring the first joining surface and the second joining surface into contact in the heated state while the joining process is being carried out, with the result that the first joining surface and the second joining surface are subjected to an opposing force action.

According to a second aspect of the present disclosure, a part, in particular for a gas turbine engine for an aircraft, more particularly a compressor-stator pair, that is to say two individual compressor-stators as a subassembly, wherein the stators can be joined, is made available, being produced by the production method according to the present disclosure.

According to a third aspect, a gas turbine engine for an aircraft is made available, having at least one part according to the present disclosure, produced by the production method according to the present disclosure.

Ideas and concepts in the present disclosure may be regarded as being based on the following observations and insights.

Sinter joining is a joining method in which two or more components in direct contact with one another at a joining surface are raised to a temperature suitable for a sinter joining process. During this process, the grain structures of a polycrystalline material coalesce. Typically, the sinter joining process is carried out at a temperature which is slightly below or even slightly above the melting temperature of the components to be joined or of the materials thereof.

Components for a sinter joining process are first of all produced in the context of a preparatory process, e.g. a metal powder injection molding process, in which a powdered material is mixed with a binder and processed into a molding in an injection molding process. A molding produced in this way is also referred to as a green compact. In a subsequent step, the binder is removed, being dissolved or removed by means of thermal treatment, for example. A resultant molding is referred to as a brown compact.

In a subsequent sintering process, the brown compact is raised to a temperature slightly below or slightly above the melting temperature of the materials thereof as explained above, resulting in a hardening reaction of the materials of the component and a simultaneous reduction in the dimensions thereof. A fully sintered part thus has reduced dimensions in comparison with the green compact and the brown compact. Typical shrinkage may be in the range of 10 to 30%.

During the sinter joining process described here, i.e. the heating of the component to the joining temperature, the thermal expansion coefficient of the material used leads initially to an increase in the dimensions or volumes of the components and the jacket element due to the expansion of the materials used and subsequently leads to the hardening of the joint. The above-described reduction in volume at the end of the joining process may take place to only a limited extent or not at all owing to pre-sintered components or fully sintered components.

The present disclosure relates to a method for applying force to join two or more subcomponents in a sintering process. Here, the application of force is advantageous for the quality of joining if the surfaces to be joined are subject to a contact pressure during sintering. Before sintering, the components to be joined are surrounded by a jacket structure, wherein the jacket structure is made from a material with lower thermal expansion than the components to be joined. Various combinations of materials for the jacket structure and the components are conceivable here, e.g. a ceramic jacket structure and a metallic component or, alternatively, jacket structures and components of the same material, such as a metallic jacket structure and a metallic component or a ceramic jacket structure and a ceramic component, with a higher melting temperature for the jacket structure than the components proving advantageous in the case of materials of the same kind. In this case too, the thermal expansion coefficient of the jacket structure is lower than the thermal expansion coefficient of the components to be joined.

Depending on the sintering temperature, the difference between the thermal expansion coefficients of the jacket structure and the components to be joined and the desired force to be applied to the joining surface, a gap can additionally be provided between the jacket structure and the components. In this case, the components to be joined can already be in the sintered state before sinter joining. As an option, a joining paste can be used between the subcomponents in order to compensate for slight irregularities in the surface or roughness during the sinter joining process.

Depending on the combination of materials for the jacket structure and components, it may be necessary to provide the jacket structure with a parting layer in order to counteract bonding between the jacket structure and the subcomponents.

Through a suitable choice of materials for the jacket structure and the metallic or alternatively, ceramic components to be joined with different thermal expansion coefficients, and taking into account the initial geometrical conditions or setting of the initial geometrical conditions before sinter joining through a suitable choice of a gap dimension between the jacket element and the components to be joined, it is possible to set the effective force during sinter joining. In this way, it is possible to implement a variable direction of action of force or a controlled force direction effect. Moreover, very high forces can be achieved by suitable dimensioning of the gap while taking into account the temperature expansion coefficients.

According to the disclosure, two components are introduced into a jacket element, wherein the jacket element at least partially encloses or surrounds the two components. In this arrangement, an opening in the jacket element is dimensioned in such a way that the two components can be introduced into the opening in the jacket element while being in contact with one another, for example. Here, the jacket element may have a gap with respect to the components.

Various developments of a sinter joining process produce a connection between two or more components by establishing a joint between joining surfaces that are in contact during the joining process, with the result that an integrally joined part is subsequently obtained from these two or more components. To form a preferred joint, it is helpful here if the components to be joined are pressed against one another with the use of a force, leading to a preferred material connection between the joining surfaces.

However, it is difficult to impose an external force on green compacts or brown compacts, in particular, owing to the porosity of the material composition of the green compact or the brown compact. In most cases, either only the weight of a component is used to press said component onto the other component during the joining process, or forces are introduced externally by means of elements in the form of small parts, e.g. "pin structures", but this may not give uniform introduction of force and, in the worst case, may lead to a nonuniform joint or deformation of the green compact or the brown compact due to nonuniform application of force, making a component unusable after production.

However, in the context of the present disclosure, presintered or (almost fully) sintered components are preferably used since these may exhibit negligible shrinkage in comparison to the change in size due to the thermal expansion coefficient, as a result of which the change in size of the components during the sinter joining process is determined substantially by the thermal expansion coefficient itself.

According to one embodiment, a gap is formed between a partial area of the jacket-element bearing surface and at least a partial area of the first bearing surface and at least a partial area of the second bearing surface at the first temperature, wherein the gap is at least partially closed at the second temperature, thus enabling a force to be applied to the first component and the second component by the jacket element.

The jacket element at least partially encloses the first component and the second component and thus essentially provides support for the first component and the second component during the joining process. When heated, the jacket element expands less than the first component and/or the second component owing to the lower temperature expansion coefficient of said jacket element. Thus, the volume of the first component and the second component, or at least the extent in one particular dimension, increases more than that of the jacket element. A previously existing gap between the first component and the second component and the jacket element is thus substantially closed or reduced to zero, as a result of which the first component and the second component rest on the jacket element and obtain support from the latter. Heating is then continued and the first component and the second component expand further in relation to the jacket element. As a result, in turn, the joining surface between the first component and the second component is subjected to an opposing force and they are thus pressed against one another since the volume of the first component and the second component increases more than the volume of the jacket element.

At the second temperature, an opposing force action is provided between at least a partial area of the first joining surface and the second joining surface so as to form the joint.

If the first component, the second component and the jacket element are heated to the second temperature, the volumes of the first component and the second component increase disproportionately to the increase in volume of the jacket element. As a result, above a certain temperature the first component and the second component rest on the respective bearing surface relative to one another, as a result of which, in turn, when heated further and thus with a continued increase in volume, the first joining surface and the second joining surface are pressed onto one another.

According to another embodiment, the gap is dimensioned in such a way as to provide a directional force action.

In the case where the first component and the second component are introduced into an opening in the jacket element, the gap between individual sides of the components and of the jacket element can have different dimensions or be dimensioned differently, with the result, for example, that two gaps of relatively small dimensions provide a force action on a joining surface, while other gaps of larger dimensions are not yet providing a force action at a certain temperature. In this way, a directional force action can be obtained, e.g. exclusively a force action perpendicular to the joining surfaces, while a lateral force action or force action perpendicular thereto, parallel to the joining surfaces, is not effected or is effectively prevented through correspondingly larger dimensioning of the gap.

According to another embodiment, a joining paste is provided between the first joining surface and the second joining surface.

A joining paste can be composed of the same material as or a similar material to the first and the second component, for example, and can achieve a preferred joint between the first joining surface and the second joining surface as part of the joining process. In this context, the joining paste can, for example, compensate for irregularities in the surface of the joining surfaces which may arise because of inaccurate machining.

A joining paste can be composed of the same material as or a similar material to the first and/or the second component, for example, and can achieve a preferred joint between the first component and the second component as part of the joining process. In this context, the joining paste can, for example, compensate for irregularities in the surface of the first component and of the second component which may arise because of inaccurate machining. Here, the joining pastes can be adapted to the specific application, being identical in terms of material to the materials of the components to be joined, for example, or, alternatively, merely being similar in terms of material, e.g. having a smaller grain size and, as a result, being quicker to melt, for example. Formation of the joining paste from a different type of material is likewise conceivable, it being possible, by way of example, for the joining paste to comprise materials with a higher activation energy.

According to another embodiment, the jacket element may surround the first component and the second component over the full periphery in at least one section plane.

The first component and the second component are thus accommodated in a substantially internal opening in the jacket element, thereby resulting in a preferential force action of the jacket element on the first component and the second component since such a closed jacket element permits only slight deformations, in particular no nonuniform deformation, that could occur as part of the joining process when the first and the second component are supported on the jacket-element bearing surfaces.

According to another embodiment, the jacket element may not surround the first component and the second component over the full periphery in one section plane, in particular surrounding it in a U shape.

The first component and the second component are thus introduced into the interior of a jacket-element opening which is not closed fully or in the form of a ring. As a result, this may be deformed nonuniformly as part of a sinter joining process, e.g. the outer ends of the legs of the U may be pushed further apart than the sides situated further away from the base owing to the different lever forces. Moreover, support for the first component and the second component in cases where a jacket element that is closed over the full periphery is unsuitable owing, for example, to the geometrical shapes of the first component and/or the second component may be possible by means of such a jacket element that is not closed over the full periphery.

According to another embodiment, the joining method is a sinter joining method.

According to another embodiment, the first component and the second component may be formed from a sinterable material and may each be in a presintered or fully sintered state.

In the context of the present disclosure, the first component and the second component may be substantially fully sintered. It is likewise conceivable for one component to be composed of a presintered material and the other component to be composed of a fully sintered material. In this way, forces can be introduced preferentially into the components in order to provide a suitable force action on the joining surfaces relative to one another without endangering or prejudicing the structural integrity of the components. In the case of the use of a merely pre-sintered component, it must be ensured that the thermal expansion of the material overcompensates the shrinkage during the sinter joining process, thus enabling force to be applied, especially since the jacket structure likewise expands slightly.

According to another embodiment, the first component and/or the second component may be formed from a material from the group comprising a ceramic material, a metallic material, a material containing nickel, a material containing cobalt, IN713LC alloy, IN718 alloy, CM247 alloy, Haynes25 alloy and Hastelloy X alloy.

In this context, a nickel-based alloy or CM247LC alloy may, in particular, be composed as follows, based on % by weight: Ni: balance; Co: 9.25%; Cr: 8.2%; W: 9.52%; Al: 5.5%; Ta: 3.16%; Hf: 1.34%; Ti: 0.8%; Mo: 0.53%; B: 0.013%; C: 0.06%; Si: <0.01%; S: 0.0017%, Zr: 0.015%.

In this context, a cobalt-based alloy or Haynes25 alloy may, in particular, be composed as follows, based on % by weight: Co: balance; C: 0.05-0.15%; Ni: 9.0-11.0%; Fe: <=3.0%; Si: <=1.0%; Mn: 1.0-2.0%; Cr: 19.0-21.0%; W: 14.0-16.0%; P: <=0.03%; S: <=0.03%.

In this context, a nickel-chromium-molybdenum-tungsten alloy or Hastelloy X alloy may, in particular, be composed as follows, based on % by weight: Ni: balance; C: <=0.01%; Si: <=0.08%; Mn: <=1.0%; P: <=0.025%; S: <=0.01%; Co: <=2.5%; Cr: 14.5-16.5%; Fe: 4.0-7.0%; Mo: 15.0-17.0%; V: <=0.35%; W: 3.0-4.5%.

According to another embodiment, a parting layer or a parting material may be provided between the jacket element and the first component and/or the second component in order to prevent the formation of a bond between the jacket element and the first component and/or the second component.

Using the parting layer or parting material, the intention is thus to prevent the first component and/or the second component in turn forming a bond and thus entering into a joint with the jacket element as part of the joining process. It may thereby be possible to ensure that the first component and the second component can simply be released from the jacket element after the joining process.

According to another embodiment, the first component and/or the second component may be designed as a stator component or compressor stator component, in particular for a gas turbine engine for an aircraft.

Stator components or compressor stator components may have particularly complex geometrical structures, as a result of which it may only be possible to produce them integrally in a single production step with increased effort, if at all. Thus, stator components, compressor stator components or subassemblies comprising compressor stators (pairs) can preferentially be constructed from individual (sub)components.

According to another embodiment, the first joining surface and/or the second joining surface may have a joining surface geometry such that a positive connection is formed between the first component and the second component after the joining process has been carried out.

Here, a positive connection in addition to the nonpositive or bonded connection of the sintered joint may provide a joint between the first component and the second component which is capable of bearing particularly high loads.

Illustrative embodiments of the present disclosure are described below with reference to the figures.

Figure 1:
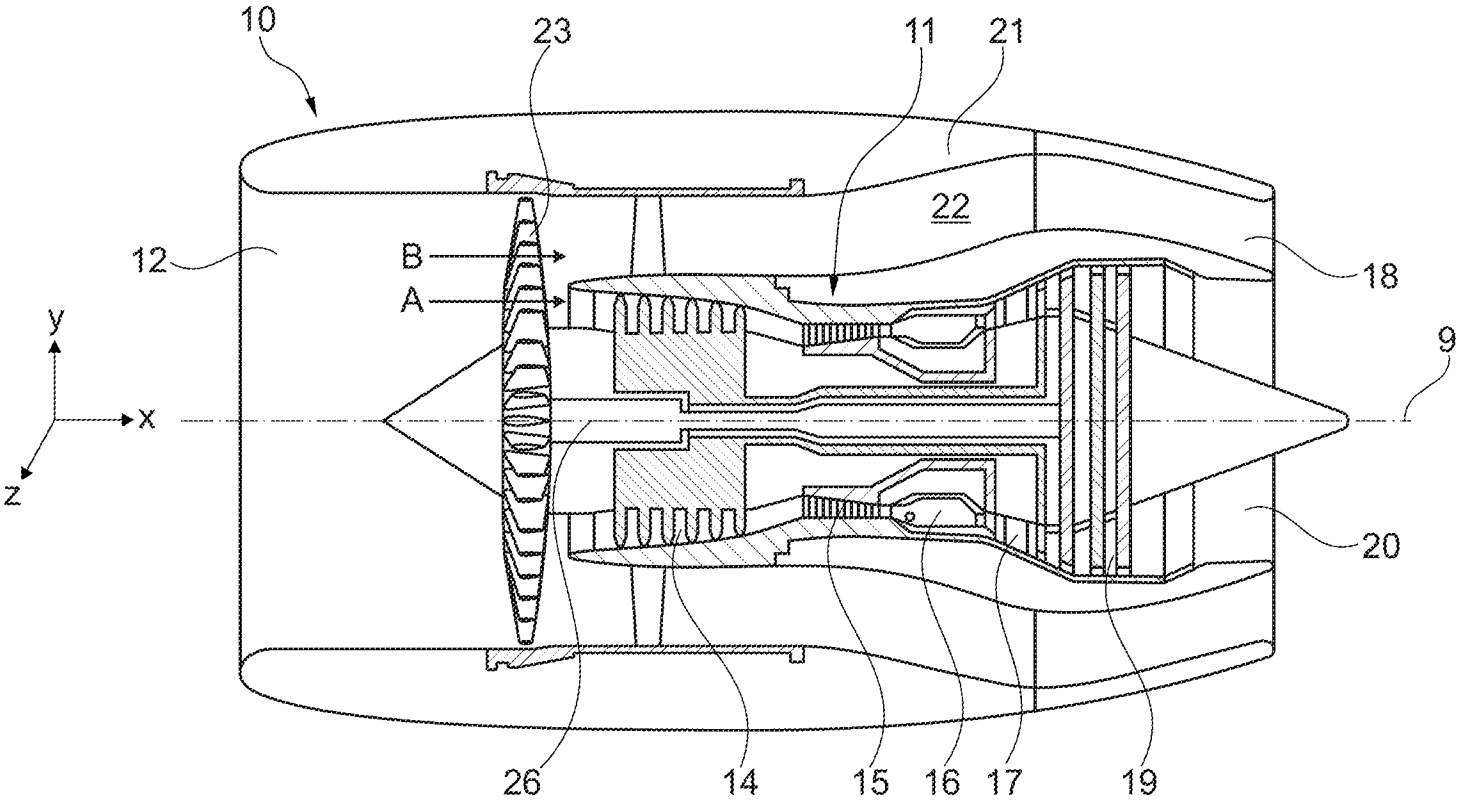
FIG. 1 shows a sectioned side view of a gas turbine engine according to the present disclosure.

FIG. 1 illustrates a gas turbine engine 10 with a primary axis of rotation 9. The engine 10 comprises an air intake 12 and a fan 23 that generates two airflows: a core airflow A and a bypass airflow B. The gas turbine engine 10 comprises a core 11 that receives the core airflow A. When viewed in the order corresponding to the axial direction of flow, the core engine 11 comprises a low pressure compressor 14, a high pressure compressor 15, a combustion device 16, a high pressure turbine 17, a low pressure turbine 19 and a core thrust nozzle 20. An engine nacelle 21 surrounds the gas turbine engine 10 and defines a bypass duct 22 and a bypass thrust nozzle 18. The bypass airflow B flows through the bypass duct 22. The fan 23 is mounted on the low pressure turbine 19 by means of a shaft 26 and is driven by said turbine.

In operation, the core airflow A is accelerated and compressed by the low pressure compressor 14 and directed into the high pressure compressor 15 where further compression takes place. The compressed air exhausted from the high pressure compressor 15 is directed into the combustion device 16, where it is mixed with fuel and the mixture is combusted. The resultant hot combustion products then expand through, and thereby drive, the high pressure and low pressure turbines 17, 19 before being exhausted through the nozzle 20 to provide some propulsive thrust. The high pressure compressor 15 is driven by the high pressure turbine 17 via an interconnecting shaft. Generally speaking, the fan 23 provides the majority of the propulsive thrust.

Note that the terms "low pressure turbine" and "low pressure compressor" as used herein may be taken to mean the lowest pressure turbine stage and lowest pressure compressor stage (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Other gas turbine engines to which the present disclosure may be applied may have alternative configurations. For example, engines of this kind may have an alternative number of compressors and/or turbines and/or an alternative number of interconnecting shafts. By way of further example, the gas turbine engine shown in FIG. 1 has a split flow nozzle 20, 22 meaning that the flow through the bypass duct 22 has its own nozzle that is separate to and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst FIG. 1 relates to a turbofan engine, the disclosure may apply, for example, to any type of gas turbine engine, such as an open rotor (in which the fan stage is not surrounded by a nacelle) or turboprop engine, for example.

The geometry of the gas turbine engine 10, and components thereof, is/are defined by a conventional axis system, comprising an axial direction (which is aligned with the rotational axis 9), a radial direction (in the bottom-to-top direction in FIG. 1), and a circumferential direction (perpendicular to the view in FIG. 1). The axial (X direction), the radial (Y direction) and the circumferential direction (Z direction) run perpendicular to one another.

Figure 2:
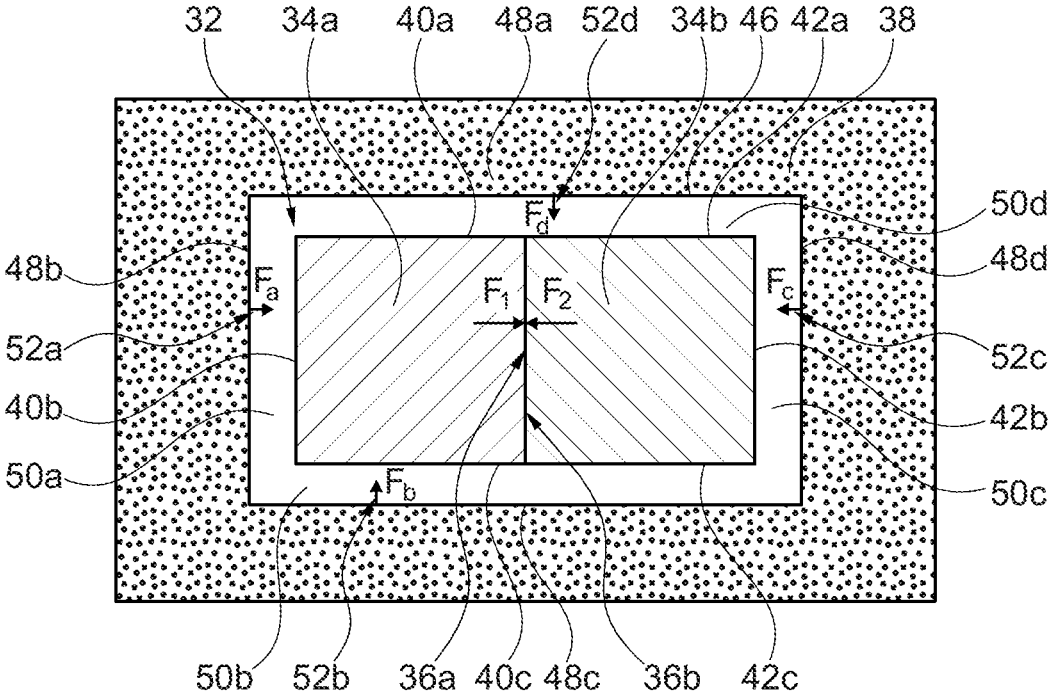
FIG. 2 shows a first illustrative arrangement of components to be joined in a jacket element as per the present disclosure.

With further reference to FIG. 2, a first illustrative arrangement of components to be joined in a jacket element as per the present disclosure is illustrated.

FIG. 2 shows a part 32, which is to be constructed from a first component 34*a* and a second component 34*b*. The first component 34*a* and the second component 34*b* rest against one another by means of the first joining surface 36*a* and the second joining surface 36*b*. A jacket surface 38 is provided with an opening 46, which, as illustrated in FIG. 2, is capable of accommodating the first component 34*a* and the second component 34*b*. A gap 50 is provided between the first bearing surfaces 40*a,b,c* of the first component 34*a* and the second bearing surfaces 42*a,b,c* of the second component 34*b* and the bearing surfaces of the jacket element 48*a,b,c,d*. In FIG. 2, by way of example, the gap 50 comprises four individual gaps 50*a,b,c,d*, which each form a clearance between the jacket element 38 and the first and second component 34*a,b*. In FIG. 2, the illustration of gap 50*a,b,c,d* is of a purely qualitative nature.

Here, FIG. 2 can be a state of the kind found at the time of a first temperature before a joining process is carried out. The first and the second component 34*a,b* have been introduced into the opening 46 of the jacket element 38 and are spaced apart from the bearing surfaces 48*a,b,c,d* thereof by gaps 50*a,b,c,d*. If heating of the first and the second component 34*a,b* together with the jacket element 38 is then carried out, the respective elements expand by different amounts owing to the different thermal expansion coefficients of the first and the second component 34*a,b* and the jacket element 38. According to the invention, the thermal expansion coefficients of the first and the second component 34*a,b* are greater than the temperature expansion coefficient of the jacket element 38. Assuming suitable dimensioning, this means that, above a certain temperature, the gap 50 closes owing to the greater expansion of the first and the second component 34*a,b* relative to the jacket element 38. In this state, the first bearing surfaces 40*a,b,c* and the second bearing surfaces 42*a,b,c* then rest at least partially on the jacket-element bearing surfaces 48*a,b,c,d*. This is not illustrated in FIG. 2.

The first bearing surfaces 40*a,b,c* and the second bearing surfaces 42*a,b,c* thus touch the bearing surfaces of the jacket element 48*a,b,c,d* at a defined temperature. If the temperature is then increased further, forces Fa, Fb, Fc and Fd emanating from the jacket-element bearing surfaces 48*a,b,c,d* act on the bearing surfaces of the first and the second component 34*a,b,* on the first bearing surfaces 40*a,b,c* and on the second bearing surfaces 42*a,b,c.* Owing to the geometrical dimensions as illustrated in FIG. 2, a force F1 and F2 due to force Fa and Fc then acts on the first and the second joining surface 36*a,b* of the first and the second component 34*a,b.* Essentially, the bearing surfaces 40*b* and 42*b* are supported on the bearing surfaces 48*b* and 48*d* of the jacket element and, owing to the continued increase in volume, exert the opposing forces F1 and F2 due to the different thermal expansion coefficients on the first and the second joining surface 36*a,b.*

In the present case, there may be a preference, for example, to make gaps 50*b* and 50*d* larger than gaps 50*a* and 50*c,* and therefore, while bearing surfaces 40*b* and 42*b* rest on bearing surfaces 48*b* and 48*d,* there is still a residual gap 50*b* and 50*d* between bearing surfaces 40*a,* 40*c* and 42*a* and 42*c* and bearing surfaces 48*a* and 48*d.*

If, to produce the part 32, the first component 34*a,* the second component 34*b* and the jacket element 38 are suitably heated in order to carry out a sinter joining process at the first joining surface 36*a* and 36*b,* a substantially integrally formed part 32 is formed after the sinter joining process. In other words, the first component 34*a* and the second component 34*b* are joined by means of the joining surfaces 36*a,b.*

Figure 3:
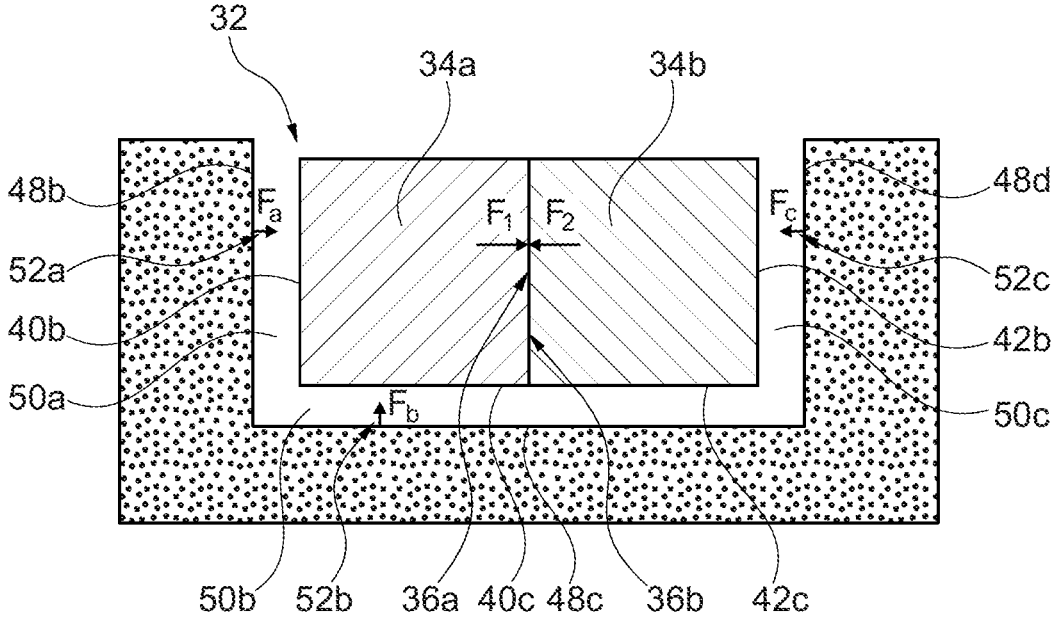
FIG. 3 shows a second illustrative arrangement of components to be joined in a jacket element as per the present disclosure.

With further reference to FIG. 3, a second illustrative arrangement of components to be joined in a jacket element as per the present disclosure is illustrated.

FIG. 3 differs from FIG. 2 only in that the jacket element 38 is not fully surrounded or closed in the form of a ring, as in FIG. 2, but has substantially a U shape. The mechanism of action in FIG. 3 is fundamentally comparable to the mechanism of action shown in FIG. 2. Owing to the U shape of the jacket element 38, however, forces Fa and Fc may not be substantially uniform over the full length of the first bearing surface 40*b* and the second bearing surface 42*b* owing to the different lever loading along the legs of the U, which is shown as open at the top in FIG. 3. At the same time, a force action Fb due solely to the friction between the first bearing surface 40*b* and the second bearing surface 42*a* relative to the jacket-element bearing surfaces 48*b* and 48*d* can be produced since there is no longer any opposing support in FIG. 3. The first component 34*a* together with the second component 34*b* is preferably arranged in such a way in the opening 46 in the jacket element 38 that no force action Fb occurs.

Such a U shape of the jacket element 38 can preferably be employed in the case where the first component 34*a* and the second component 34*a* have complex geometrical structures which make it impossible, for example, to use a jacket element 38 in the form of a closed ring.

Depending on the dimensions of the jacket element 38, of the first component 34*a* and of the second component 34*b,* the nonuniform force action Fa and Fc may affect the quality of the joint between the first joining surface 36*a* and the second joining surface 36*b.*

Figure 4:
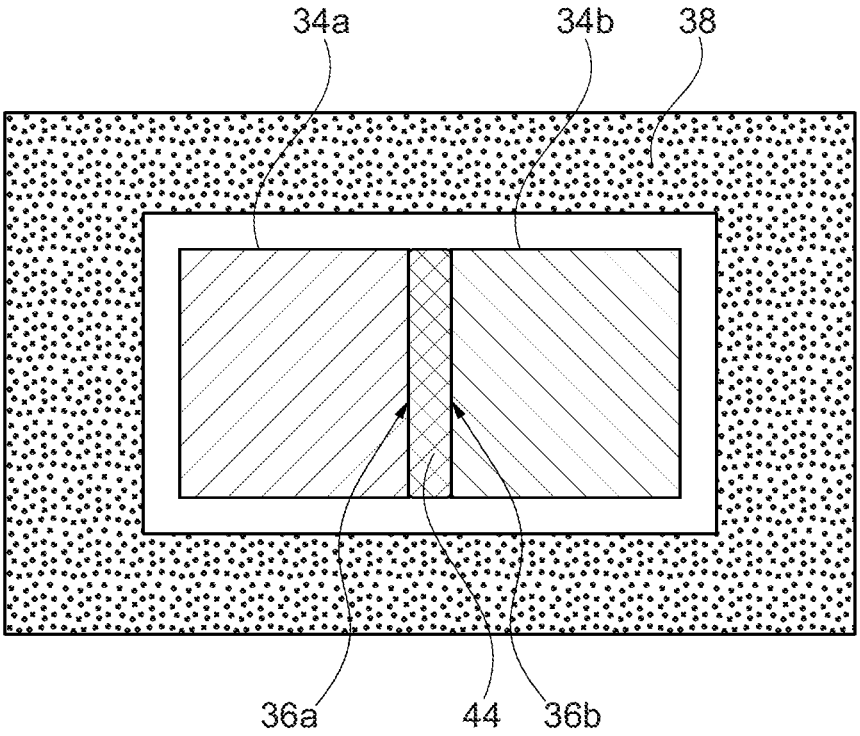
FIG. 4 shows a third illustrative arrangement of components to be joined in a jacket element as per the present disclosure.

With further reference to FIG. 4, a third illustrative arrangement of components to be joined in a jacket element as per the present disclosure is illustrated.

Here, FIG. 4 corresponds to the embodiment in FIG. 2, but a joining paste 44 has been introduced between the first joining surface 36*a* and the second joining surface 36*b.* In this context, a joining paste 44 is composed of comparable or similar materials to the first component 34*a* and the second component 34*b.* The joining paste 44 is preferably used to assist the production of the joint between the first joining surface 36*a* and the second joining surface 36*b* in that the joining paste 44 can compensate for surface irregularities in the first and the second joining surface 36*a,b.* In FIG. 4, the joining paste 44 is illustrated in a purely qualitative manner and is not true to scale.

Figure 5:
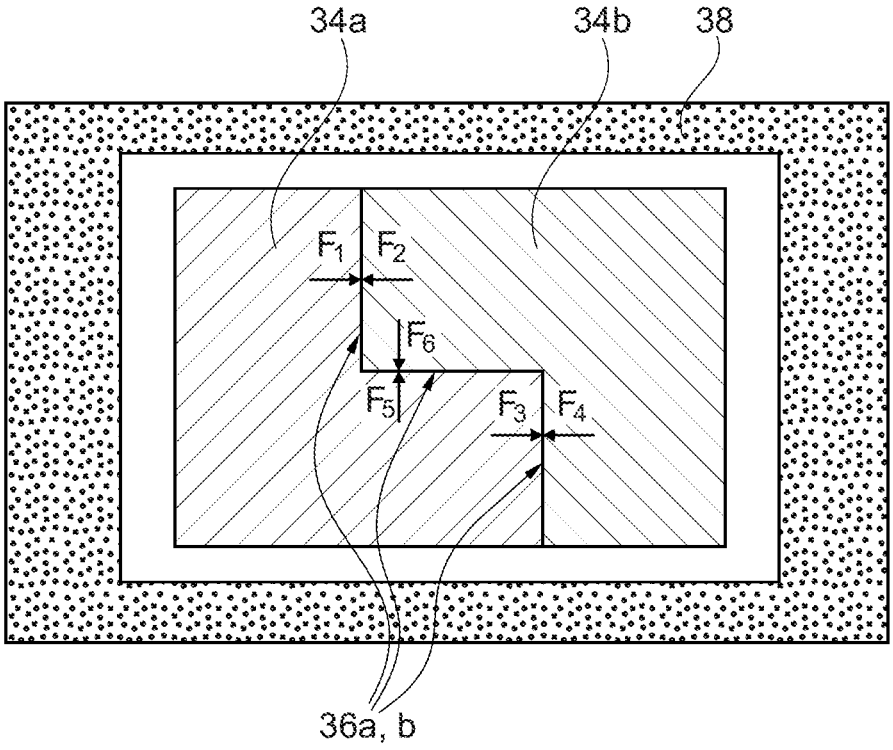
FIG. 5 shows a fourth illustrative arrangement of components to be joined in a jacket element as per the present disclosure.

With further reference to FIG. 5, a fourth illustrative arrangement of components to be joined in a jacket element as per the present disclosure is illustrated.

FIG. 5 corresponds substantially to the structure in FIG. 2, with the difference of a first and second joining surface 36*a,b* which are not level but are instead offset. Such a design of the first and the second joining surface 36*a,b* while taking into account suitable gap dimensioning makes it possible to use not only force action Fa and Fc but also, in like fashion, Fb and Fd to produce the joint between the first and the second joining surface 36*a,b.* Thus, in FIG. 5, not only are there forces F1, F2 and F3, F4 acting in a horizontal direction but also forces F5 and F6 acting in a vertical direction on the two individual joining surfaces to form the joint between the first and the second joining surface 36*a,b.* A joint of this kind may presuppose suitable dimensioning of the gaps 50*a,b,c,d.*

Figure 6:
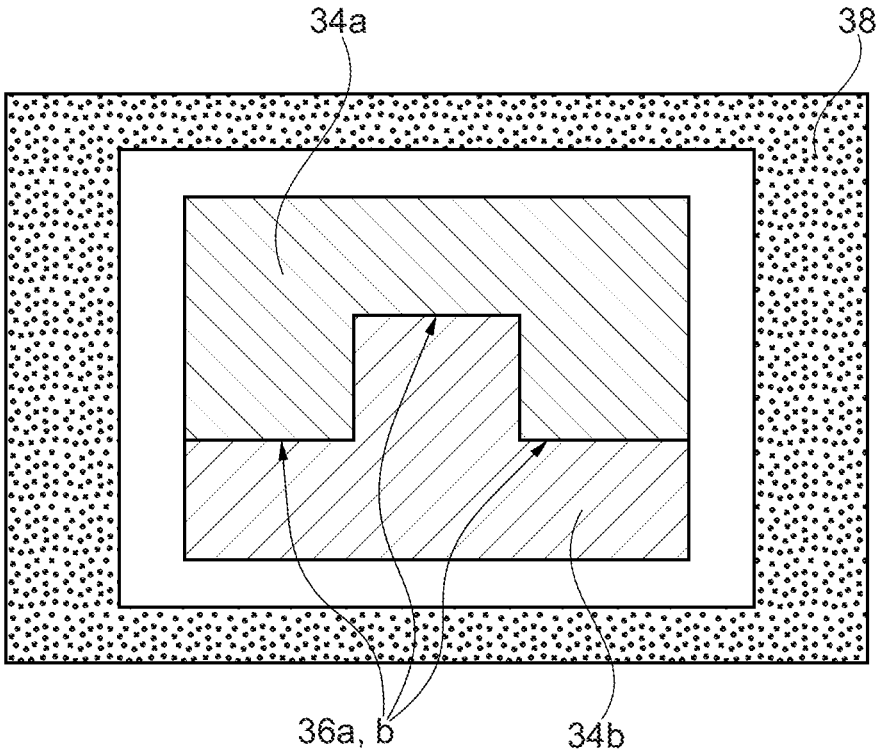
FIG. 6 shows a fifth illustrative arrangement of components to be joined in a jacket element as per the present disclosure.

With further reference to FIG. 6, a fifth illustrative arrangement of components to be joined in a jacket element as per the present disclosure is illustrated.

Here, FIG. 6 corresponds substantially to FIG. 2 but has a particular geometrical configuration of the first and the second joining surface 36*a,b.* Thus, one joining surface is surrounded over the full periphery on three sides by the other joining surface. This results not only in a nonpositive connection between the first and the second joining surface 36*a,b* but also, by virtue of the configuration or interlocking of the joining surfaces, in a positive connection.

Production of the positive connection between the first joining surface 36*a* and the second joining surface 36*b* can be assisted through suitable dimensioning and selection of the materials for the first component 34*a* and the second component 34*b.* Thus, for example, the first component 34*a* and the second component 34*b* can comprise a slightly different material with slightly different thermal expansion coefficients and/or slight differences in a presintered state. Thus, for example, the second component 34*a* may be easy to introduce into the first component 34*b* before the sinter joining process but be connected to the latter in a substantially integral way after the sintering process has been carried out. For this purpose, the second component 34*b* has a slightly higher thermal expansion coefficient than component 34*a,* for example.

The provision of a sinter joining paste 44 is likewise conceivable in all the embodiments in FIGS. 5 and 6.

Figure 7:
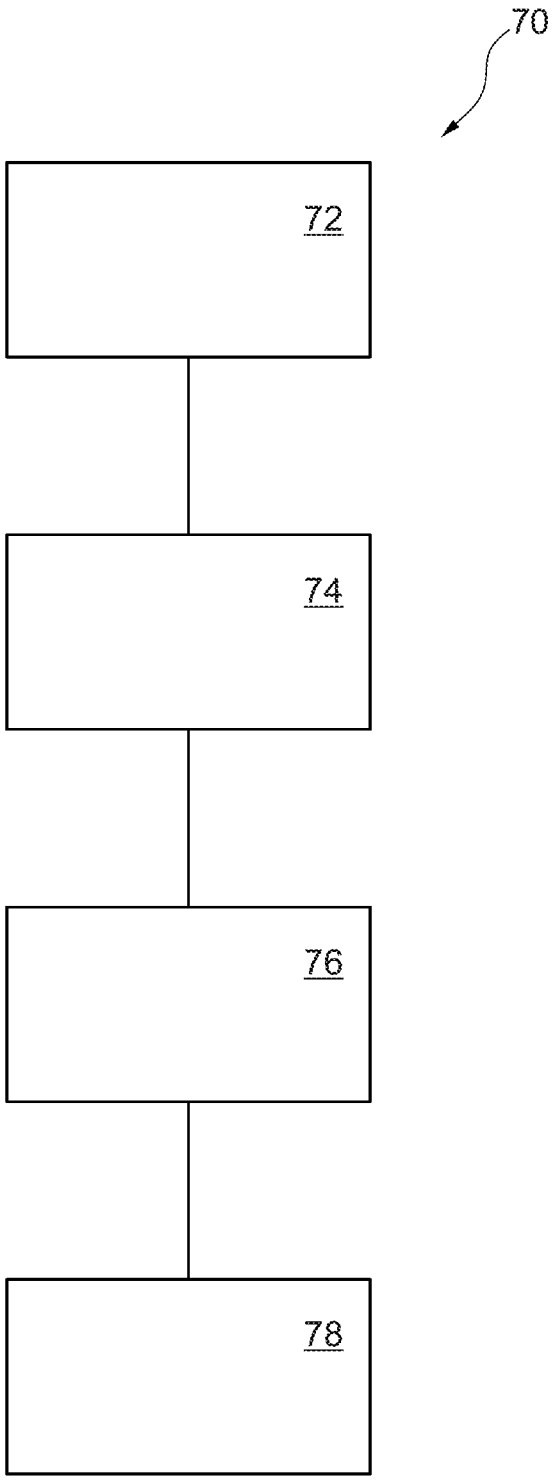
FIG. 7 shows a method for producing a complex component as per the present disclosure.

With further reference to FIG. 7, a method for producing a complex component as per the present disclosure is described.

FIG. 7 shows a method (70) for producing a complex part (32), comprising making available (72) a first component (34*a*), having a thermal expansion coefficient of the first component; a first joining surface (36*a*); and a first bearing surface (40*a,* 40*b,* 40*c*); making available (74) a second component (34*b*), having a thermal expansion coefficient of the second component; a second joining surface (36*b*); and a second bearing surface (42*a,* 42*b,* 42*c*); and making available (76) a jacket element (38), having a thermal expansion coefficient of the jacket element; and a jacket-element bearing surface (48*a*, 48*b*, 48*c*, 48*d*); and heating (78) the first component (34*a*), the second component (34*b*) and the jacket element (38) from a first temperature to a second temperature in order to carry out a joining process on the first component (34*a*) and the second component (34*b*), wherein the first component (34*a*) and the second component (34*b*) can be brought into contact in at least a partial area of the first joining surface (36*a*) and of the second joining surface (36*b*), thus enabling a joint to be formed in the area of contact between the first joining surface (36*a*) and the second joining surface (36*b*); wherein the jacket element (38) at least partially surrounds the first component (34*a*) and the second component (34*b*); wherein the jacket-element bearing surface (48*a*, 48*b*, 48*c*, 48*d*) can be brought into contact with the first bearing surface (40*a*, 40*b*, 40*c*) and the second bearing surface (42*a*, 42*b*, 42*c*); wherein the thermal expansion coefficient of the jacket element is lower than the thermal expansion coefficient of the first component and/or the thermal expansion coefficient of the second component; and wherein the thermal expansion coefficient of the jacket element and the thermal expansion coefficient of the first component and/or the thermal expansion coefficient of the second component are designed in such a way as to bring the jacket-element bearing surface (48*a*, 48*b*, 48*c*, 48*d*) into contact with the first bearing surface (40*a*, 40*b*, 40*c*) and the second bearing surface (42*a*, 42*b*, 42*c*) and to bring the first joining surface (36*a*) and the second joining surface (36*b*) into contact in the heated state while the joining process is being carried out, with the result that the first joining surface (36*a*) and the second joining surface (36*b*) are subjected to an opposing force action.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

Finally, attention is drawn to the fact that terms such as "having" or "comprising" do not exclude other elements or steps and that "a" or "an" does not exclude a plural. Elements which are described in connection with various embodiments can be combined. Reference signs in the claims should not be interpreted as restrictive.

LIST OF REFERENCE SIGNS

9 Main axis of rotation
10 Engine
11 Core
12 Air intake
14 Low pressure compressor
15 High pressure compressor
16 Combustion device
17 High pressure turbine
18 Bypass thrust nozzle
19 Low pressure turbine
20 Core thrust nozzle
21 Engine nacelle
22 Bypass duct
23 Fan
A Core airflow
B Bypass airflow
26 Interconnecting shaft
32 Part
34*a*,*b* First, second component
36*a*,*b* First, second joining surface
38 Jacket element
40*a*,*b*,*c* First bearing surfaces
42*a*,*b*,*c* Second bearing surfaces
44 Joining paste
46 Opening in jacket element
48*a*,*b*,*c*,*d* Jacket-element bearing surfaces
50*a*,*b*,*c*,*d* Gap
52*a*,*b*,*c*,*d* Force
$F_a$,$F_b$,$F_c$,$F_d$ Force on first/second component
$F_1$,$F_2$,$F_3$,$F_4$,$F_5$,$F_6$ Force on joining surfaces
70 Method for producing a complex part
72 Making available a first component
74 Making available a second component
76 Making available a jacket element
78 Heating

The invention claimed is:

1. A method for producing a complex part, comprising:
providing a first component, including:
a first thermal expansion coefficient;
a first joining surface; and
a first bearing surface;
providing a second component, including:
a second thermal expansion coefficient;
a second joining surface; and
a second bearing surface; and
providing a jacket element, including:
a third thermal expansion coefficient; and
a jacket element bearing surface;
positioning the first component and the second component to be brought into contact in at least a partial area of contact of the first joining surface and of the second joining surface, thus enabling a joint to be formed in the area of contact between the first joining surface and the second joining surface;
providing that the jacket element at least partially surrounds the first component and the second component;
positioning the jacket element bearing surface to be brought into contact with the first bearing surface and the second bearing surface;
providing that the third thermal expansion coefficient of the jacket element is lower than the first thermal expansion coefficient of the first component and/or the second thermal expansion coefficient of the second component such that heating of the jacket element, the first component and the second component from a given first temperature to a given second temperature brings the jacket element bearing surface into contact with the first bearing surface and the second bearing surface through thermal expansion and thereby apply an opposing joining force between the first joining surface and the second joining surface;
heating the first component, the second component and the jacket element from the first temperature to the second temperature in order to apply the opposing joining force between the first joining surface and the second joining surface through the thermal expansion to join the first component and the second component;
providing that the joining of the first component and the second component is performed by a sinter joining method.

2. The method according to claim 1, and further comprising providing a gap between at least a partial area of the jacket element bearing surface and at least a partial area of the first bearing surface and at least a partial area of the second bearing surface at the first temperature, and further providing that the gap is closed at the second temperature to apply the opposing joining force.

3. The method according to claim 2, and further comprising dimensioning the gap around a periphery of the first component and the second component in such a way as to provide a directional force action on the first component and the second component by the jacket element.

4. The method according to claim 1, and further comprising providing a joining paste between the first joining surface and the second joining surface.

5. The method according to claim 1, and further comprising providing that the jacket element surrounds the first component and the second component over a full periphery of the first component and the second component in at least one section plane.

6. The method according to claim 1, and further comprising providing that the jacket element only partially surrounds a periphery of the first component and the second component in one section plane.

7. The method according to claim 1, and further comprising providing that the first component and the second component are formed from a sinterable material and are each in a presintered or fully sintered state.

8. The method according to claim 1, and further comprising providing that the first component and the second component are formed from a ceramic material or a metallic material.

9. The method according to claim 1, and further comprising providing a parting layer or a parting material between the jacket element and the first component and/or the second component in order to prevent formation of a bond between the jacket element and the first component and/or the second component.

10. The method according to claim 1, and further comprising providing that the first component and/or the second component are configured as a stator component or compressor stator component.

11. The method according to claim 1, and further comprising providing that the first joining surface and/or the second joining surface have/has a joining surface geometry to form at least a partial interlocking connection between the first component and the second component.

12. The method according to claim 1, wherein the jacket element only partially surrounds a periphery of the first component and the second component in a U-shape, in one section plane.

13. The method according to claim 1, wherein the first component and/or the second component are configured as a stator component or compressor stator component for a gas turbine engine for an aircraft.

14. A method for producing a complex part, comprising:

providing a first component, including:

a first thermal expansion coefficient;

a first joining surface; and a first bearing surface;

providing a second component, including:

a second thermal expansion coefficient;

a second joining surface; and a second bearing surface; and providing a jacket element, including:

a third thermal expansion coefficient; and a jacket element bearing surface;

positioning the first component and the second component to be brought into contact in at least a partial area of contact of the first joining surface and of the second joining surface, thus enabling a joint to be formed in the area of contact between the first joining surface and the second joining surface;

providing that the jacket element at least partially surrounds the first component and the second component;

positioning the jacket element bearing surface to be brought into contact with the first bearing surface and the second bearing surface;

providing that the third thermal expansion coefficient of the jacket element is lower than the first thermal expansion coefficient of the first component and/or the second thermal expansion coefficient of the second component such that heating of the jacket element, the first component and the second component from a given first temperature to a given second temperature brings the jacket element bearing surface into contact with the first bearing surface and the second bearing surface through thermal expansion and thereby apply an opposing joining force between the first joining surface and the second joining surface;

heating the first component, the second component and the jacket element from the first temperature to the second temperature in order to apply the opposing joining force between the first joining surface and the second joining surface through the thermal expansion to join the first component and the second component;

providing that the first component and the second component are formed from a ceramic material or a metallic material.

15. A method for producing a complex part, comprising:

providing a first component, including:

a first thermal expansion coefficient;

a first joining surface; and a first bearing surface;

providing a second component, including:

a second thermal expansion coefficient;

a second joining surface; and a second bearing surface; and providing a jacket element, including:

a third thermal expansion coefficient; and a jacket element bearing surface;

positioning the first component and the second component to be brought into contact in at least a partial area of contact of the first joining surface and of the second joining surface, thus enabling a joint to be formed in the area of contact between the first joining surface and the second joining surface;

providing that the jacket element at least partially surrounds the first component and the second component;

positioning the jacket element bearing surface to be brought into contact with the first bearing surface and the second bearing surface;

providing that the third thermal expansion coefficient of the jacket element is lower than the first thermal expansion coefficient of the first component and/or the second thermal expansion coefficient of the second component such that heating of the jacket element, the first component and the second component from a given first temperature to a given second temperature brings the jacket element bearing surface into contact with the first bearing surface and the second bearing surface through thermal expansion and thereby apply an opposing joining force between the first joining surface and the second joining surface;

heating the first component, the second component and the jacket element from the first temperature to the second temperature in order to apply the opposing joining force between the first joining surface and the second joining surface through the thermal expansion to join the first component and the second component;

providing that the first component and/or the second component are configured as a stator component or compressor stator component.

* * * * *